US009309886B2

(12) United States Patent
Taguchi

(10) Patent No.: US 9,309,886 B2
(45) Date of Patent: Apr. 12, 2016

(54) INVERTER-INTEGRATED ELECTRIC COMPRESSOR

(75) Inventor: Tatsuhisa Taguchi, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 815 days.

(21) Appl. No.: 13/497,752

(22) PCT Filed: Sep. 3, 2010

(86) PCT No.: PCT/JP2010/005426
§ 371 (c)(1),
(2), (4) Date: Mar. 22, 2012

(87) PCT Pub. No.: WO2011/036847
PCT Pub. Date: Mar. 31, 2011

(65) Prior Publication Data

US 2012/0183420 A1 Jul. 19, 2012

(30) Foreign Application Priority Data

Sep. 28, 2009 (JP) ..... 2009-222233
Jan. 27, 2010 (JP) ..... 2010-014956

(51) Int. Cl.
*F04B 35/04* (2006.01)
*F04C 23/00* (2006.01)
(Continued)

(52) U.S. Cl.
CPC ..... *F04C 23/008* (2013.01); *F01C 21/10* (2013.01); *F04B 39/06* (2013.01); *F04B 39/12* (2013.01); *F04C 29/047* (2013.01);
(Continued)

(58) Field of Classification Search
CPC ..... F04C 29/047; F04C 2240/30; F04C 2240/808; F04C 23/08; F04C 29/04; F04C 2240/40; F04C 2240/403; F04C 2240/803; F04C 2240/806
USPC ..... 417/44.1, 410.1, 423.14; 310/98 R, 71
See application file for complete search history.

(56) References Cited

U.S. PATENT DOCUMENTS 6,345,507 B1 * 2/2002 Gillen ..... 62/3.7
6,552,912 B1 * 4/2003 Kanazawa et al. ..... 361/752
(Continued)

FOREIGN PATENT DOCUMENTS

EP 2204581 7/2010
JP 2000-291557 10/2000
(Continued)

OTHER PUBLICATIONS

JP 2005171951 machine translation,Jun. 2005,Makino et al.*
(Continued)

*Primary Examiner* — Charles Freay
(74) *Attorney, Agent, or Firm* — Hamre, Schumann, Mueller & Larson, P.C.

(57) ABSTRACT

An inverter-integrated electric compressor comprising a compressing mechanism portion which sucks, compresses and discharges fluid, a motor which drives the compressing mechanism portion, a body casing in which the motor is incorporated, the body casing being hermetically closed, a suction passage formed in one of ends of the body casing, and an inverter case in which an inverter for driving the motor is incorporated. At least a portion of the inverter case is closely brought into contact with and fixed to, in its axial direction, the body casing in which the suction passage is formed.

12 Claims, 10 Drawing Sheets

(51) Int. Cl.

| | |
|---|---|
| ***F04B 39/06*** | (2006.01) |
| ***F04B 39/12*** | (2006.01) |
| ***F04C 29/04*** | (2006.01) |
| ***F01C 21/10*** | (2006.01) |
| *F04C 18/02* | (2006.01) |

(52) U.S. Cl.
CPC ..... *F04C 18/0215* (2013.01); *F04C 2240/803* (2013.01); *F04C 2240/808* (2013.01)

(56) References Cited

U.S. PATENT DOCUMENTS

| | | | | |
|---|---|---|---|---|
| 6,704,202 | B1 * | 3/2004 | Hamaoka et al. | 361/704 |
| 7,207,187 | B2 * | 4/2007 | Funahashi et al. | 62/228.4 |
| 2001/0022939 | A1 | 9/2001 | Morita et al. | |
| 2002/0039532 | A1 | 4/2002 | Saito et al. | |
| 2003/0094920 | A1 * | 5/2003 | Numaguchi et al. | 318/801 |
| 2003/0200761 | A1 * | 10/2003 | Funahashi et al. | 62/228.4 |
| 2004/0197213 | A1 * | 10/2004 | Takemoto | 417/410.1 |
| 2004/0251928 | A1 * | 12/2004 | Taguchi et al. | 324/772 |
| 2005/0223727 | A1 * | 10/2005 | Funahashi et al. | 62/228.4 |

FOREIGN PATENT DOCUMENTS

| | | |
|---|---|---|
| JP | 2004-183631 | 7/2004 |
| JP | 2005-146862 | 6/2005 |
| JP | 2005171951 A * | 6/2005 |
| JP | 2005-188441 | 7/2005 |
| JP | 2007-292044 | 11/2007 |
| JP | 2008-175067 | 7/2008 |
| JP | 2009-074517 | 4/2009 |

OTHER PUBLICATIONS

Supplementary European Search Report issued Apr. 15, 2015 in corresponding European application No. 10818528.1, 6 pages total.

* cited by examiner

INVERTER-INTEGRATED ELECTRIC COMPRESSOR

TECHNICAL FIELD

The present invention relates to an electric compressor which has a machine body container in which a compressing mechanism portion for sucking, compressing and discharging fluid, and a motor for driving the compressing mechanism portion are incorporated, and which drives the motor by an inverter.

BACKGROUND TECHNIQUE

In an electric compressor of this type, an inverter, a compressing mechanism portion and a motor are provided such that they are partitioned from each other (see patent documents 1 and 2 for example). According to an electric compressor disclosed in patent document 1, as shown in FIG. 13, a partition wall 104 is provided in a machine body container 101 for partitioning the machine body container 101 in its axial direction into a compression chamber 102 and an inverter chamber 103, a compressing mechanism portion 105 and a motor 106 are accommodated in the compression chamber 102, and an inverter 107 is accommodated in the inverter chamber 103. The inverter 107 is mounted such that the inverter 107 faces a suction port 108 where the motor 106 is located through the partition wall 104. The inverter 107 and the motor 106 are cooled by refrigerant sucked from the suction port 108 and then, the refrigerant flows into the compressing mechanism portion 105 (so-called low pressure type compressor).

As shown in FIG. 14, an electric compressor disclosed in patent document 2 includes a machine body container 112 in which a motor 111 and a compressing mechanism portion 113 are accommodated, and an inverter case 115 in which an inverter 114 is accommodated. The inverter case 115 is fastened to an end of a machine body container through a bolt, and the machine body container is located on the opposite side from the motor 111 across the compressing mechanism portion 105.

A suction hole 116 is provided in the compressing mechanism portion 113, sucked refrigerant which flows from the suction hole 116 is once introduced into a passage 117 provided in the inverter case 115, heat is exchanged between the refrigerant and the inverter 114 and then, the refrigerant returns to the compressing mechanism portion 113 again. Refrigerant gas which is compressed by the compressing mechanism portion 113 cools the motor 111 and then, the refrigerant is discharged from a discharge hole 118 provided in the machine body container 112 (so-called high pressure type compressor).

Among high pressure type compressors, there is one described in patent document 3. A structure described in patent document 3 is shown in FIGS. 15 and 16. Although an inverter-integrated compressor shown in FIG. 15 is originally a lateral type but the inverter-integrated compressor is shows as a vertical type. FIG. 16 is an exploded view showing a structure of a cooling passage space including an inverter case 102 and a fixed blade 11 which forms a compressing mechanism portion.

According to this compressor, a compressing mechanism portion 4 is incorporated in a body casing 1, and an inverter case 102 closes the body casing 1. Refrigerant sucked from a suction pipe mounting portion 8 (see FIG. 16) provided in the inverter case 102 is dispersed to the suction passage 10 to cool an end wall 102*a* of the inverter case 102, heat is exchanged between the refrigerant and a heating element such as an IPM (intelligent power module) 105 or the like provided on a back surface of the end wall 102*a* to cool the heating element and then, the refrigerant flows into a compression space through a suction port 11*a* (see FIG. 16) of the fixed blade 11 which configures the compressing mechanism portion 4.

A compressor terminal 106 is fixed to the inverter case 102 through a snap ring 80 (see FIG. 16). A lead wire 2*a* from the motor (not shown) is connected to a cluster 106*a* through a communication passage 82 (see FIG. 16) provided in the vicinity of an outer periphery of the fixed blade 11, and is inserted into and fixed to the compressor terminal 106. A portion of the compressor terminal 106 on the side of the inverter is directly connected to a circuit substrate 101 through soldering or the like.

A guide fin 75 which controls a flow of refrigerant is provided on the end wall 102*a* of the inverter case 102 at a location opposed to the heating element such as the IPM 105, thereby enhancing a cooling effect.

PRIOR ART DOCUMENTS

Patent Documents

[Patent Document 1] Japanese Patent Application Laid-open No. 2000-291557

[Patent Document 2] Japanese Patent Application Laid-open No. 2004-183631

[Patent Document 3] Japanese Patent Application Laid-open No. 2007-292044

SUMMARY OF THE INVENTION

Problem to be Solved by the Invention

According to the structure described in patent document 1, after heat is exchanged between sucked refrigerant and a high-heat generating part of the inverter 107 and the motor 106, the sucked refrigerant is sucked into the compressing mechanism portion 105. Therefore, volumetric efficiency is deteriorated due to temperature rise of the sucked refrigerant, and compressor performance is largely influenced. Discharged refrigerant from the compressing mechanism portion 105 does not reach the motor 106 and is discharged directly to outside. Therefore, if attempt is made to separate lubricating oil which adheres to discharged refrigerant to enhance the performance of a refrigeration cycle, lubricating oil can be separated only during a discharging process to outside, and it is difficult to separate the lubricating oil. Hence, a full-scale large separating apparatus is required, and this increases the machine body container in size and weight.

According to the structure described in patent document 2, as compared with the structure described in patent document 1, sucked refrigerant is utilized only for cooling the inverter, and a separating apparatus for lubricating oil can be provided utilizing an empty space of the machine body container 112 where the motor 111 is accommodated. Therefore, there are large merits in terms of performance and a size of the machine body container.

In the structure described in patent document 2, however, a sucked refrigerant passage 117 provided in the inverter case 115 is separated from a discharged refrigerant passage from the compressing mechanism portion 113 through the partition wall, the sucked refrigerant passage 117 and the discharged refrigerant passage approach each other, and the inverter case 115 is heated by heat transfer from the machine body container 117 whose temperature rises by heat from the compressing mechanism portion 113 and the motor 111. Therefore, this structure needs efficient cooling means and device for making it difficult to transfer heat to the inverter case 115. Further, the machine body container 117 in which the compressing mechanism portion 113 and the motor 111 are incorporated and the inverter case 115 are of laminated structures. Hence, there are problems concerning assembling adjustments, shaft centering, the numbers of bolts for fastening and the number of seals.

The structure described in patent document 3 has the following problems in addition to the problems described concerning patent document 2. That is, when the compressor is provided in a vehicle, a position of a suction pipe connecting portion 8 and a position of a high voltage connector 107 are frequently varied in many cases. At that time, since the high voltage connector 107 which introduces high voltage to the suction pipe mounting portion 8 and the inverter is disposed in the inverter case 102, design of the circuit substrate 101 in the inverter case 102 must be changed including a connector position of the inverter case 102 whenever the position of the suction pipe mounting portion 8 and the position of the high voltage connector 107 are changed, and there is a drawback that the number of steps of design is largely increased. Further, when a compressor body, i.e., a portion on the side of the body casing is produced and the inverter case 102 is coalesced and assembled, if producing places of the compressor body and the inverter case 102 are far from each other, there is fear that litter and moisture enters the compressor body and rust is generated when the compressor body is transported or stored, and this structure also has a problem in terms of manufacturability.

It is an object of the present invention to effectively cool an inverter circuit substrate, to provide an inverter-integrated electric compressor in which the inverter circuit substrate and an inverter case can efficiently be designed by commonalizing the inverter circuit substrate and the inverter case, flexibility of design of a suction pipe connecting portion is enhanced, and the drawback of the compressor body in terms of manufacturability is solved.

Means for Solving the Problems

To solve the conventional problems, the present invention provides an inverter-integrated electric compressor compressing mechanism portion which sucks, compresses and discharges fluid, a motor which drives the compressing mechanism portion, a body casing in which the compressing mechanism portion and the motor are incorporated, the body casing being hermetically closed, a suction passage formed in one of ends of the body casing, and an inverter case in which an inverter for driving the motor is incorporated, wherein the body casing has a suction passage-forming surface in which the suction passage is provided, the suction passage-forming surface is cooled by a refrigerant flowing through the suction passage, at least a portion of the inverter case is closely brought into contact with the suction passage-forming surface and the inverter case is fixed to the suction passage-forming surface. A back surface of an inverter installation wall of the inverter case is cooled by a sucked refrigerant flowing through the suction passage. As a result, the circuit substrate in the inverter case can be cooled. When the compressor body is transported or stored, it is possible to prevent litter and moisture from entering the body casing and to prevent rust from generating.

When a structure in which the inverter case can rotate to an arbitrary position and can be fixed to the body casing is employed, a position of the high voltage connector can be changed only by changing a position where the inverter case is fixed, a change of type of vehicle can be accepted while using the common inverter case and circuit substrate as they are, and design flexibility is enhanced.

Effect of the Invention

According to the present invention, the suction passage for refrigerant exists in the body casing, and the inverter circuit substrate in the inverter case can efficiently be cooled by a refrigerant which flows through the suction passage, and the body casing can be reduced in size. It is possible to provide an inverter-integrated electric compressor capable of preventing litter and moisture from entering when the body casing is transported or stored.

EXPLANATION OF SYMBOLS

Figure 1:
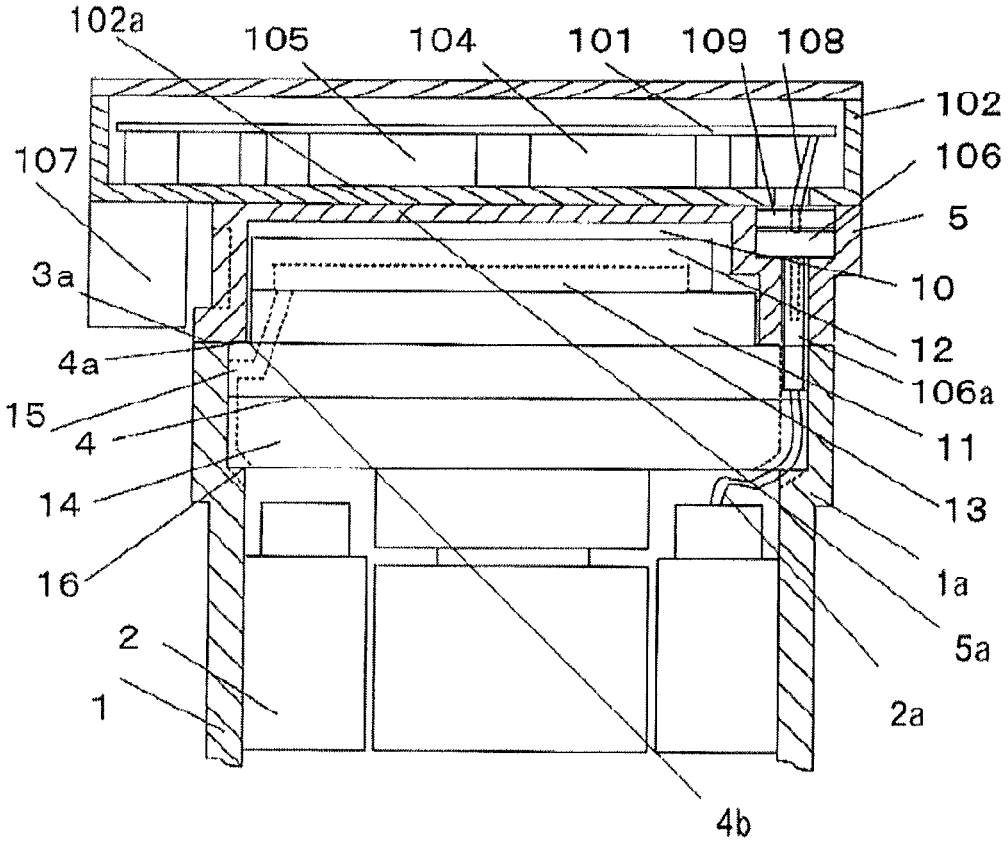
FIG. 1 is a partial sectional view of an electric compressor of a first embodiment of the present invention.

1 body casing (barrel)
2 motor
2*a* lead wire
3*a* outer seal material
4 compressing mechanism portion
4*a* step
4*b* inner seal material
5 body casing (suction cover)
8 suction pipe mounting portion
10 suction passage
11 fixed blade
11*a* suction port
12 lid

13 discharge chamber
14 main bearing member
15 communication passage
16 discharge hole
75 guide fin
80 snap ring
101 circuit substrate
101*a* lead wire-pull out portion
102 inverter case
102*a* end wall
104 capacitor
105 IPM
106 compressor terminal
106*a* cluster
107 high voltage connector
108 lead wire
109 inverter cluster
110 flat surface
111 thermal insulation material
112 gap
113 thermal conductivity material
120 central member
121 connecting column
122 fixing bolt
123 connecting harness

MODE FOR CARRYING OUT THE INVENTION

A first aspect of the present invention provides an inverter-integrated electric compressor comprising a compressing mechanism portion which sucks, compresses and discharges fluid, a motor which drives the compressing mechanism portion, a body casing in which the compressing mechanism portion and the motor are incorporated, the body casing being hermetically closed, a suction passage formed in one of ends of the body casing, and an inverter case in which an inverter for driving the motor is incorporated, wherein the body casing has a suction passage-forming surface in which the suction passage is provided, the suction passage-forming surface is cooled by a refrigerant flowing through the suction passage, at least a portion of the inverter case is closely brought into contact with the suction passage-forming surface and the inverter case is fixed to the suction passage-forming surface. According to this configuration, the inverter case is closely brought into contact with and disposed on the body casing in which the suction passage is formed, and it is possible to sufficiently cool the inverter.

According to a second aspect of the invention, the inverter case rotates to an arbitrary position with respect to the body casing and the inverter case can be fixed. According to this, a position of the high voltage connector can be changed only by changing a position where the inverter case is fixed, a change of type of vehicle can be accepted while using the common inverter case and circuit substrate as they are, and design flexibility is enhanced.

According to a third aspect of the invention, an electrode end terminal of a compressor terminal is disposed on an axial end surface of the body casing in which the suction passage is formed, and a circuit substrate in the inverter case is coupled to the electrode end terminal of the compressor terminal through a lead wire of the circuit substrate. According to this, it becomes easy to assemble the compressor while keeping the sufficient cooling effect of the inverter.

According to a fourth aspect of the invention, at least one of a high voltage connector which introduces high voltage from outside, a communication connector and a low voltage connector is disposed in the inverter case. It is possible to rotatably dispose the suction pipe installation portion in accordance with need of layout According to a fifth aspect of the invention, at least one of a high voltage connector, a communication connector and a low voltage connector is disposed on an outer periphery of the inverter case, and is connected to the circuit substrate of the inverter case through a connecting harness. According to this, design flexibility in accordance with a positional relation between the connectors and the circuit substrate is enhanced.

According to a sixth aspect of the invention, at least central portions of the inverter case and the body casing where the inverter case and the body casing are fixed to each other have excellent flat surfaces, they are closely brought into contact with each other, at least portions of their outer peripheries are closely brought into contact with and fixed to each other through a thermal insulation material or a gap. According to this, it is possible to cool the inverter and to insulate heat from the compressing mechanism portion.

According to a seventh aspect of the invention, the central portion of the inverter case is in intimate contact with the central portion of the body casing through a thermal conductivity material. According to this, it is possible to cool the inverter and to insulate heat from the compressing mechanism portion.

According to an eighth aspect of the invention, an outer peripheral portion of the inverter case is cut and removed, a central portion thereof is connected through a plurality of coupling rods, the central portion is closely brought into contact with the suction passage-forming surface of the body casing, an end surface of the cut and removed outer peripheral portion of the inverter case is closely brought into contact with and fixed to an outer periphery of the body casing through a thermal insulation material. According to this, it is possible to cool the inverter and to insulate heat from the compressing mechanism portion.

According to a ninth aspect of the invention, the central portion of the inverter case is separated from an outer periphery and is fixed to the body casing, and an end surface of the outer peripheral portion of the inverter case is closely brought into contact with and fixed to the body casing through a thermal insulation material. According to this, it is possible to cool the inverter and to insulate heat from the compressing mechanism portion.

Embodiments of the present invention will be described with reference to the drawings. The invention is not limited to the embodiments.

First Embodiment

FIG. 1 is a partial sectional view showing a configuration of an inverter-integrated electric compressor according to a first embodiment of the invention. In FIG. 1, one example of a lateral type electric compressor which is laterally disposed is shown vertically. A motor 2 is incorporated in a body casing 1, and a compressing mechanism portion 4 which is fitted into or press-fitted into the body casing 1 is driven. The body casing 1 is closed with a suction cover 5 which configures the body casing 1 on the side of the compressing mechanism portion 4. The suction cover 5 configures a portion of the body casing 1.

The motor 2 is driven by a motor-driving circuit substrate 101 incorporated in the inverter case 102. Basically, the electric compressor suffices if it includes the compressing mechanism portion 4 which sucks, compresses and discharges liquid, the body casing 1 in which the motor 2 for driving the compressing mechanism portion 4 is incorporated, and the inverter case 102 in which a circuit substrate 101 having a motor-driving circuit portion for driving the motor 2 is incorporated. The invention is not limited to the following embodiments.

As the compressing mechanism portion 4 which configures the electric compressor of the embodiment, a scroll compressing mechanism is shown as one example. The compressing mechanism portion 4 is accommodated in the body casing 1, and the compressing mechanism portion 4 is sandwiched and fixed between an inner peripheral end surface of the suction cover 5 and an inner surface step 1*a* of the body casing 1. The body casing 1 is hermetically closed using an outer seal material 3*a* provided between an end surface of the body casing 1 and an outer peripheral side end surface of the suction cover 5, and the body casing 1 doubly hermetically closed using an inner seal material 4*b* provided between an inner peripheral side end surface of the suction cover 5 with which the outer seal material 3*a* is in contact and a step 4*a* disposed on an outer periphery of the compressing mechanism portion 4, and the suction passage 10 for refrigerant is formed in an internal hermetic space thereof. A refrigerant which flows through the suction passage 10 and is sucked into the compressing mechanism portion 4 cools an installation wall of an inverter part such as an IPM incorporated in the inverter case 102 through the suction cover 5. The double seal members 3*a* and 4*b* are made of thermal insulation material, thereby suppressing heat transfer from the body casing 1 to the suction cover 5.

The compressing mechanism portion 4 is of a known configuration in which a refrigerant is compressed by a combination of the fixed blade 11 and a turning blade (not shown), and a portion of the fixed blade 11 on the side of the suction passage 10 is provided with a discharge chamber 13 from which a compressed refrigerant is discharged. A discharge port (not shown) of the fixed blade 11 of the discharge chamber 13 is covered with a lid 12, and the discharge chamber 13 is located in the suction passage 10, thereby shortening the length of the body casing 1 in its axial direction. That is, the body casing 1 can be made compact. The discharge chamber 13 is in communication with the motor 2 through a communication passage 15 and a discharge hole 16 formed between the fixed blade 11 and a main bearing member 14 or between the fixed blade 11, the main bearing member 14 and the body casing 1. According to this, a compressed refrigerant discharged from the discharge chamber 13 flows toward the motor 2 and is discharged outside of the body casing 1. When the refrigerant flows through the motor 2, lubricating oil is separated. That is, since the motor 2 in the body casing 1 also exerts a separating function of lubricating oil, it is unnecessary to provide a separating mechanism, and the compressor can be made compact.

Figure 2:
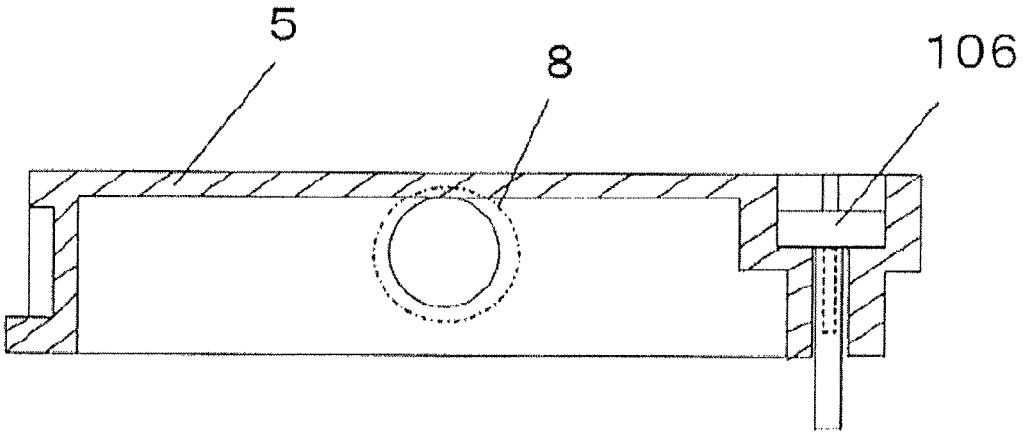
FIG. 2 is a sectional view showing a suction case of the electric compressor.
Figure 16:
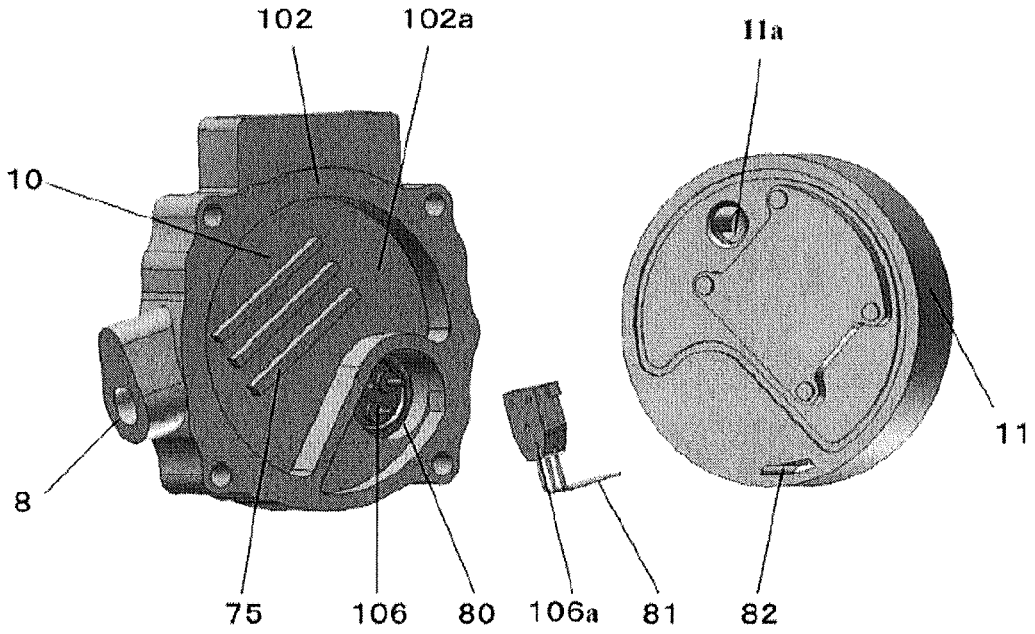
FIG. 16 is an exploded view showing a structure of essential portions of the inverter-integrated electric compressor of the third conventional example.

FIG. 2 shows the suction cover 5 which configures a portion of the body casing 1. The suction cover 5 is provided at its peripheral wall with a suction pipe mounting portion 8. A refrigerant sucked from the suction pipe mounting portion 8 enters the suction passage 10 and is dispersed, and the refrigerant cools the end wall 102*a* of the inverter case 102 through the suction cover 5. The end wall 102*a* exchanges heat with a heating element such as an IPM 105 provided such that the IPM 105 is in intimate contact with a back surface of the end wall 102*a*, thereby cooling the heating element. Thereafter, the refrigerant flows into a compression space formed between the fixed blade 11 and the turning blade through a suction port (same as the suction port 11*a* of the conventional example shown in FIG. 16) of the fixed blade 11.

Figure 3:
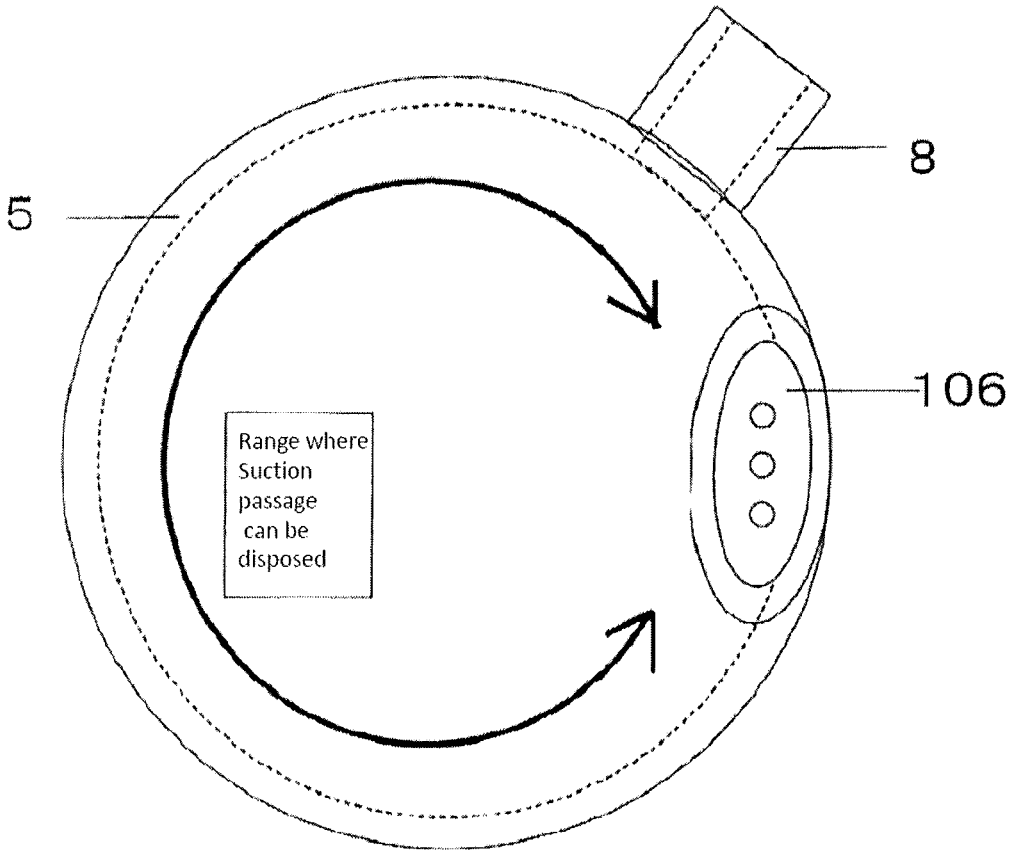
FIG. 3 is a plan view of the suction case.

The suction pipe mounting portion 8 is disposed in a region that can be in communication with the suction passage 10 of the suction cover. As shown in FIG. 3, if a range in a rotation direction of a driving shaft which drives the turning blade is viewed as shown in FIG. 3, this region is a range shown with arrows, and a range where the suction pipe mounting portion 8 can be disposed is wide.

A compressor terminal 106 is disposed on an outer periphery of the suction cover 5. As shown in FIG. 3, three end terminals of the compressor terminal 106 are straightly disposed along an outer periphery as shown in FIG. 1. A lead wire 2*a* from the motor 2 is connected to the terminal compressor 106. The lead wire 2*a* is connected to a cluster 106*a* through a communication passage provided in the vicinity of an outer periphery of the fixed blade 11, and the lead wire 2*a* is inserted into and fixed to the compressor terminal 106 from inside.

Figure 4:
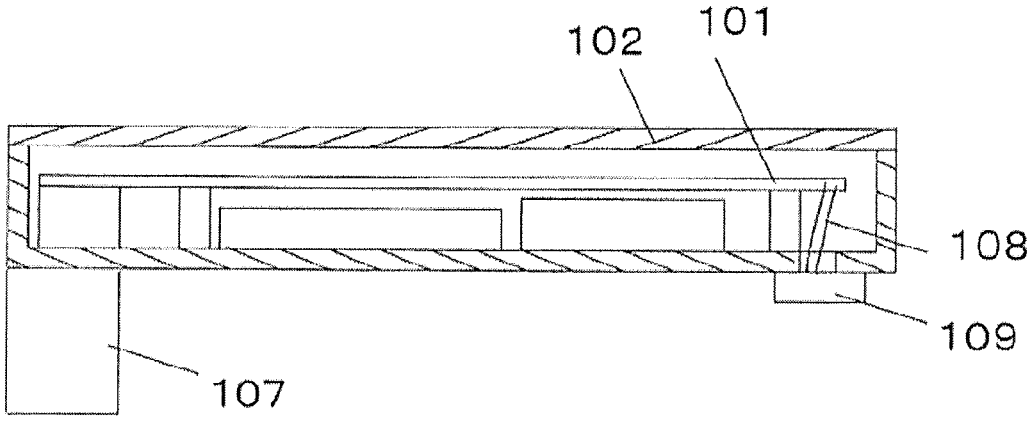
FIG. 4 is a sectional view showing an inverter case of the electric compressor.

FIG. 4 shows the inverter case 102, and a motor-driving circuit portion is provided in the inverter case 102. The motor-driving circuit portion is configured such that a circuit substrate 101 and an electrolytic capacitor 104 are accommodated in the inverter case 102, and an IPM (intelligent power module) 105 including a switching element which generates high heat is provided on the circuit substrate 101. The motor-driving circuit portion is electrically connected through the compressor terminal 106 which is connected to the motor 2, and drives the motor 2. The motor 2 is driven while monitoring necessary information such as a temperature. Hence, a high voltage connector 107 which introduces electricity from outside is first connected to the circuit substrate 101 having the motor-driving circuit portion. The compressor terminal 106 is disposed in the suction cover 5. The circuit substrate 101 is provided with an inverter cluster 109 for connecting the circuit substrate 101 to the compressor terminal 106 through the lead wire 108 extending from the lead wire pull-out portion 101*a* (see FIG. 5) of the circuit substrate 101.

Figure 5:
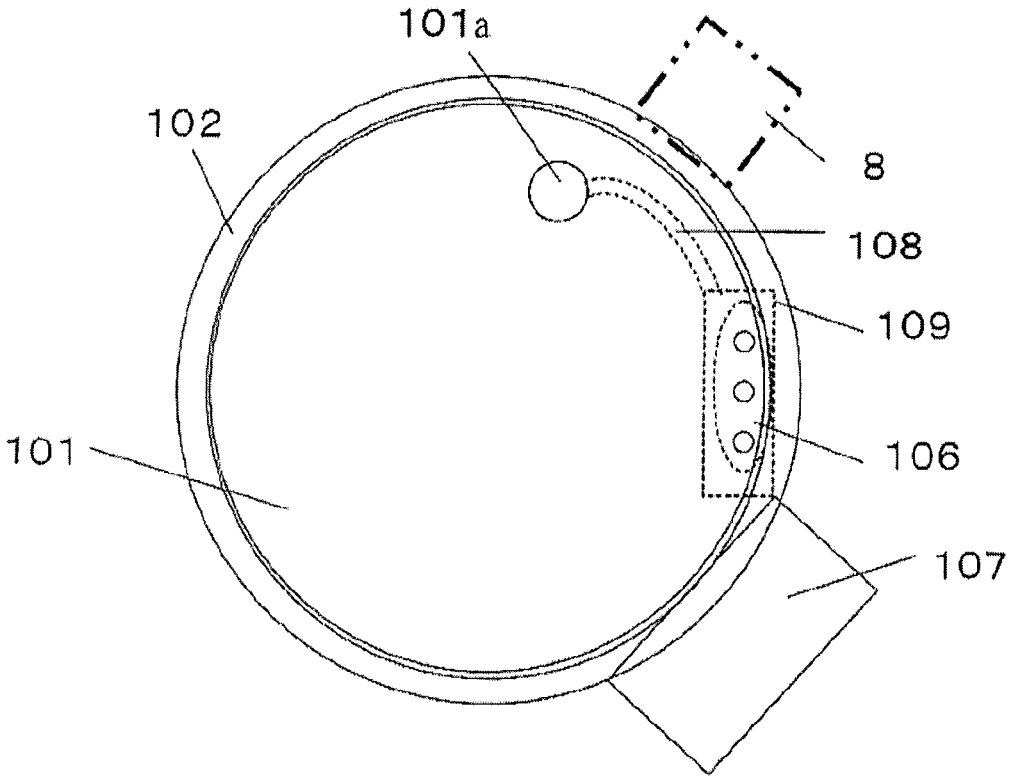
FIG. 5 is a plan view showing configurations of layout of various portions.
Figure 6:
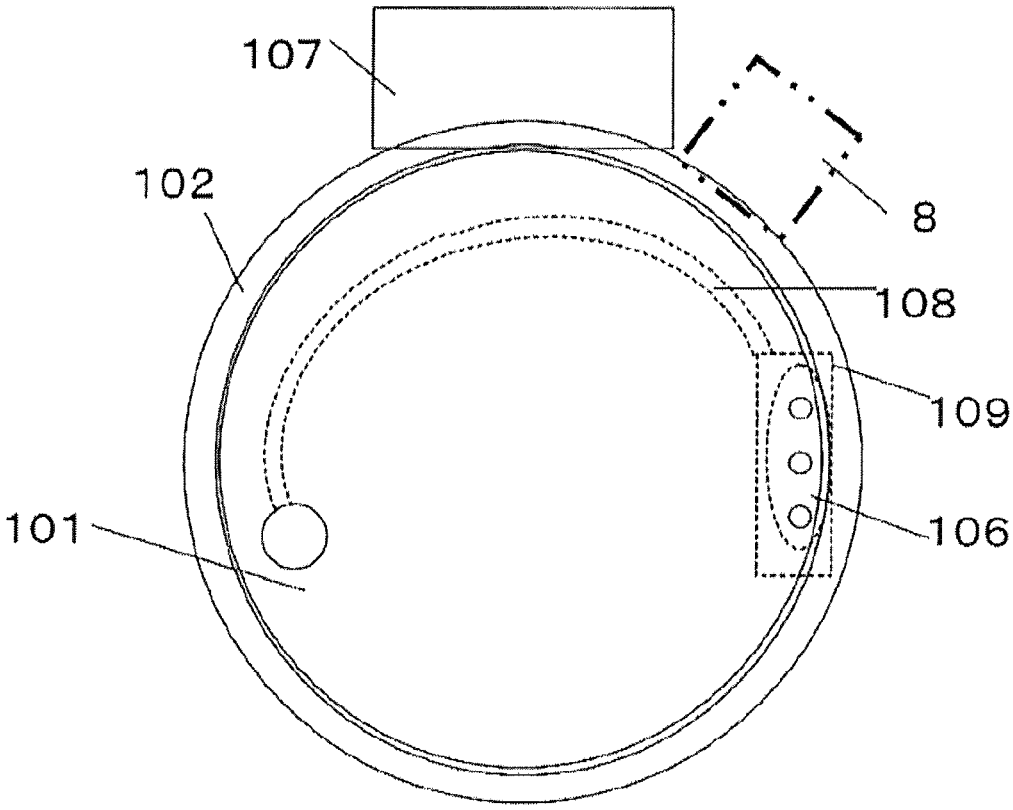
FIG. 6 is a plan view showing other configurations of layout of various portions.

FIGS. 5 and 6 are plan views showing a mounting manner of the inverter case 102 to various parts, and respectively shows a case where the high voltage connector 107 is disposed at a lower right position and a case the high voltage connector 107 moves to an upper position.

When the high voltage connector 107 moves to the position shown in FIG. 5 to the position shown in FIG. 6 for example, the inverter case 102 is rotated in a counterclockwise direction 120° with respect to a body casing 1, and the lead wire 108 of the inverter cluster 109 is extended. According to this, the inverter cluster 109 can be disposed on the compressor terminal 106 without changing a shape and a pattern wiring of the circuit substrate 101. A coupling/fixing portion between the suction cover 5 of the body casing 1 and the inverter case 102 may have a structure in which the inverter case 102 is rotated to an arbitrary position with respect to the suction cover 5 of the body casing so that the inverter case 102 can be coupled and fixed to the suction cover 5, and the coupling/fixing portion is of circular or polygonal shape.

It is described that the position of the high voltage connector which introduces high voltage from outside is changed, but the high voltage connector is not limited to this configuration, it is possible to employ such a configuration that at least one of a communication connector for communication and a 12V-low voltage connector is disposed and a position of one of them is changed.

Next, intimate connection/coupling between the suction cover 5 and the inverter case 102 will be described.

To cool the heating element such as the IPM 105 in the inverter case 102, it is important that the end wall 102*a* of the inverter case 102 (surface which is opposed to the circuit substrate 101 and the IPM 105 provided on the circuit substrate 101) and a suction passage-forming surface 5*a* of the suction cover 5 are made as member having excellent thermal conduction, and that thermal conduction resistance between both the end wall 102*a* and the suction passage-forming surface 5*a* is lowered. Several examples of configurations will be described below.

Figure 7:
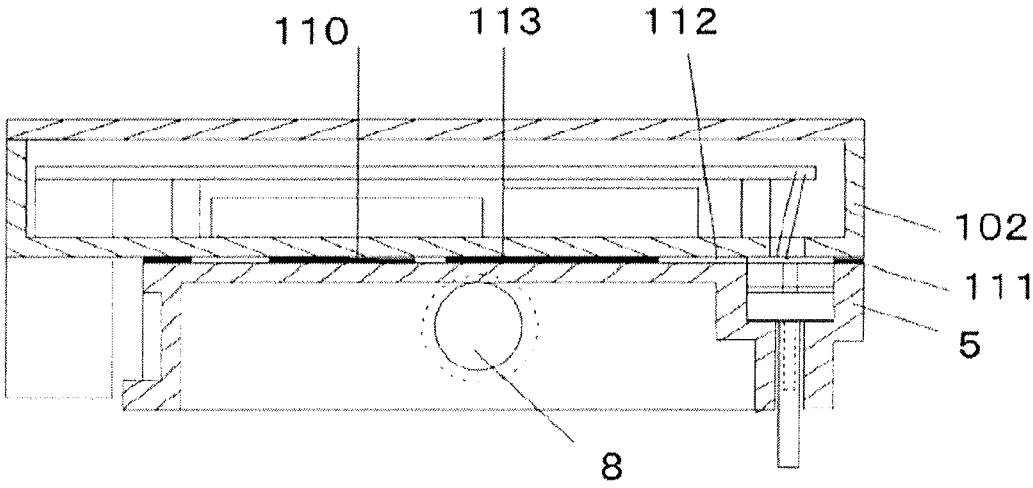
FIG. 7 is a sectional view showing a first layout example of the inverter case and a suction cover of the electric compressor.

In FIG. 7, at least central portions of a surface of the end wall 102*a* of the inverter case 102 and a surface of the suction passage-forming surface 5*a* of the suction cover 5 which come close to each other where the heating element such as the IPM 105 is disposed are made of metal material having excellent thermal conductivity and formed as excellently flat surfaces 110 (high flatness and low surface roughness) and these surfaces are closely brought into contact with each other, and a thermal insulation material 111 or a gap 112 is disposed on a portion in the vicinity of the body casing 1 which is heated by a discharged refrigerant gas or at least a portion of an outer periphery where the compressor terminal 106 is disposed, and the thermal insulation material 111 or the gap 112 are closely brought into contact with and fixed to the portion in the vicinity of the body casing 1 or at least the portion of the outer periphery.

According to this configuration, thermal conductivity of a portion which should cool the heating element such as the IPM 105 becomes excellent, it is possible to suppress heat transfer from the outer periphery of the suction cover 5 of the inverter case 1 whose temperature rise due to influence of a high temperature discharged refrigerant gas, and even if the compressor is of high pressure type in which discharged refrigerant gas passes through the body casing 1 and is discharged, it is possible to effectively cool the circuit substrate 101 including the heating element such as the IPM 105.

As another means, a thermal conductivity material 113 (e.g., thermal conductivity grease, high thermal conductive graphite sheet or the like) between at least central portions of a surface of the end wall 102*a* of the inverter case 102 and a surface of the suction passage-forming surface 5*a* of the suction cover 5 which come close to each other where the heating element such as the IPM 105 may be disposed, and these surfaces may be closely brought into contact with and fixed to at least a portion of the outer periphery through the thermal insulation material 111 or the gap 112. In this case also, the same effect as that of the former example can be obtained.

Figure 8:
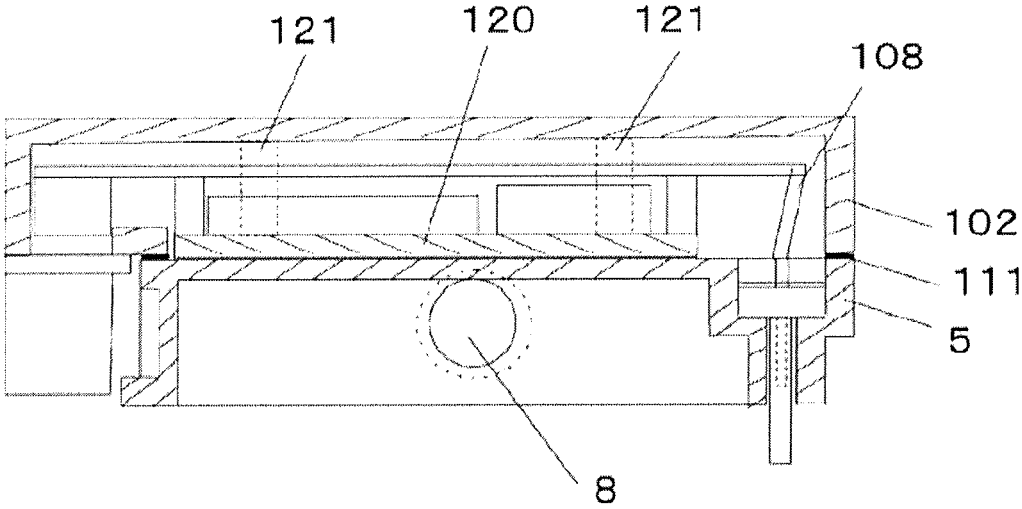
FIG. 8 is a sectional view showing a second layout example of the inverter case and the suction cover.

FIG. 8 shows a structure capable of more strongly cooling the heating element such as the IPM 105. That is, an outer periphery of the end wall 102*a* of the inverter case 102 in this example is cut and removed, and a central portion 120 thereof is connected through a plurality of coupling rods 121. The central portion 120 is closely brought into contact with the suction passage-forming surface 5*a* of the suction cover 5 of the body casing 1, an end surface of the outer periphery of the cut inverter case 102 is closely brought into contact with an outer periphery of the suction cover 5 through the thermal insulation material 111 and is fixed.

According to this configuration, the central portion 120 of the inverter case 102 cools the heating element such as the IPM 105 with a heat sink function, heat transfer from the outer periphery portion of the suction cover 5 is suppressed of course, the heat transfer is suppressed, it is also possible to suppress the heat transfer, to the central portion 120, from the outer periphery portion of the inverter case 102 whose temperature is prone to rise through the thermal insulation material 111, and it is possible to more strongly cool the circuit substrate 101 including the heating element such as the IPM 105.

Figure 9:
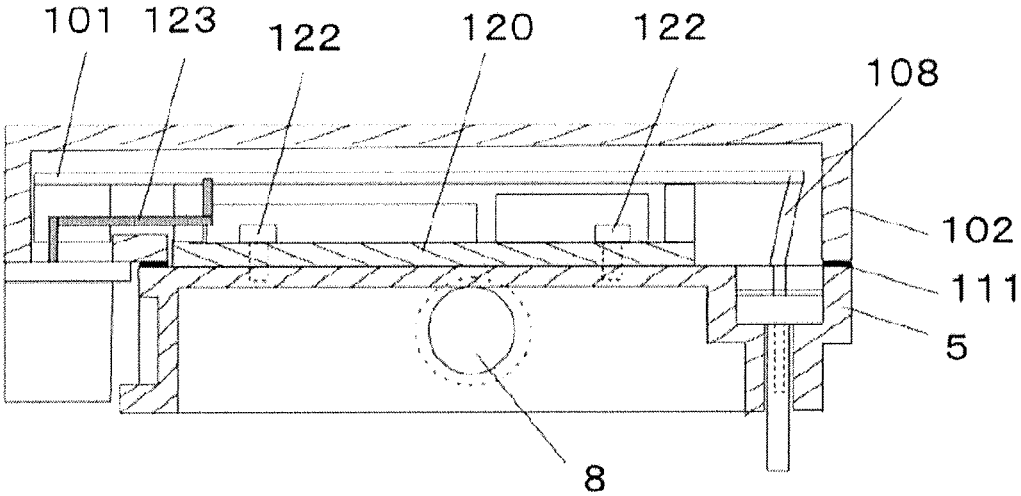
FIG. 9 is a sectional view showing a third layout example of the inverter case and the suction cover.

FIG. 9 shows a structure in which the central portion 120 of the inverter case 102 shown in FIG. 8 is connected to the suction cover 5 through connecting bolts 122. Intimate connection between the central portion 120 of the inverter case 102 and the suction passage-forming surface 5*a* of the suction cover 5 can be reliable for a long term.

When the central portion 120 is connected to the suction cover 5 through bolts, as a structure for securing flexibility of rotation installation of the inverter case 102, a connecting harness 123 is added to connect the circuit substrate 101, the high voltage connector disposed in the inverter case 102, a communication connector and a low voltage connector to each other.

Figure 10:
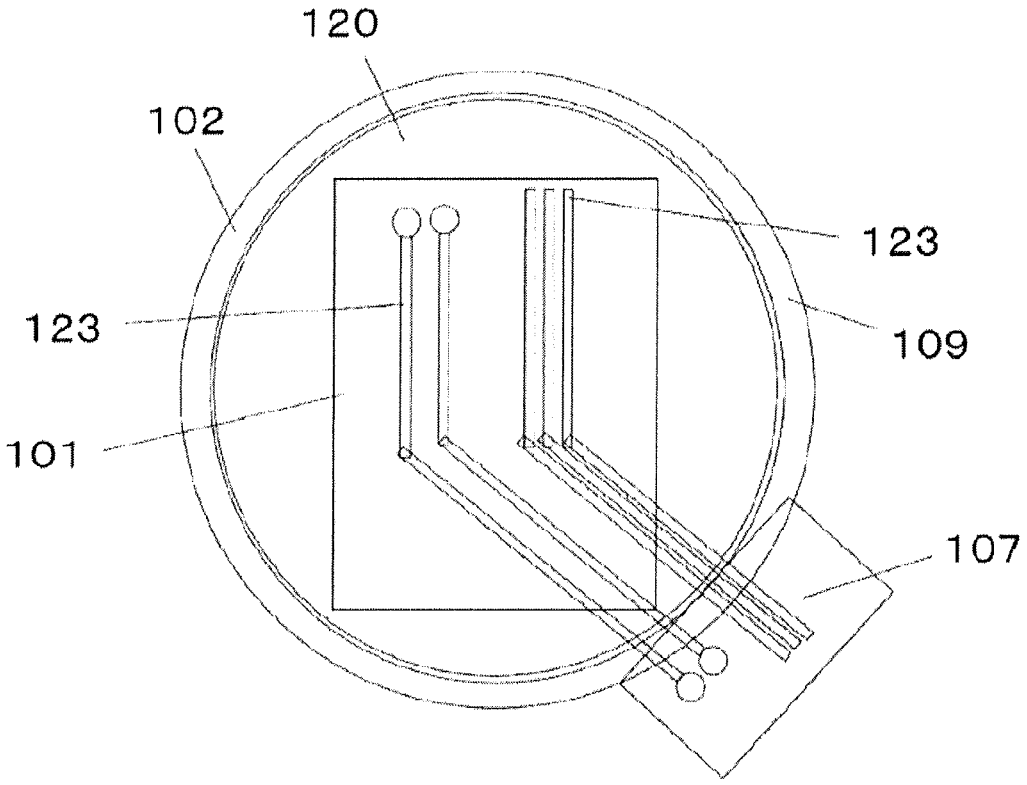
FIG. 10 is a plan view showing a first layout example of the inverter case of the electric compressor.
Figure 11:
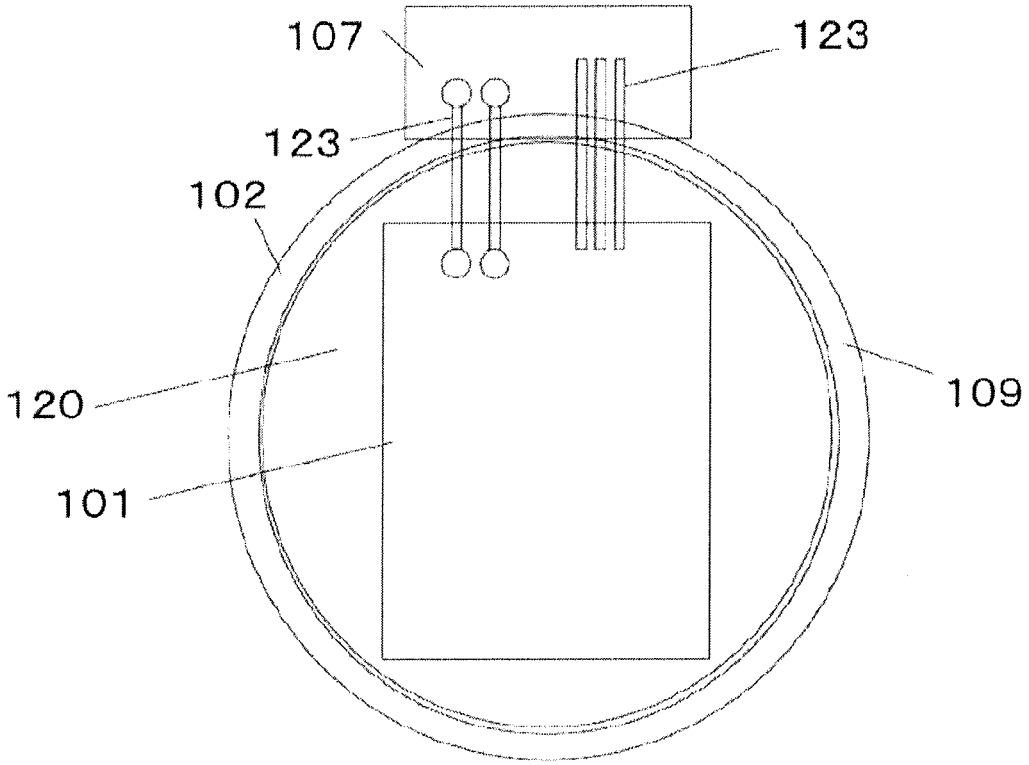
FIG. 11 is a plan view showing a second layout example of the inverter case.

FIGS. 10 and 11 show an example of connecting harnesses 123 when a position of a connector is changed with respect to the same circuit substrate 101.

As described above, each of the embodiments includes the suction pipe installation portion, the inverter case is disposed on the body casing in which the suction passage is formed such that the inverter case is in intimate contact with the body casing so that the inverter can sufficiently be cooled. The suction pipe installation portion is rotatably disposed in accordance with need of layout, the inverter case and the circuit substrate can be commoditized, flexibility of disposition of the suction pipe and flexibility of installation of the high voltage connector are enhanced, design efficiency of the inverter case and the circuit substrate is largely enhanced, and it is possible to obtain the inverter-integrated compressor which solves the drawback in terms of manufacturability of transportation and storage of the compressor body.

Second Embodiment

Figure 12:
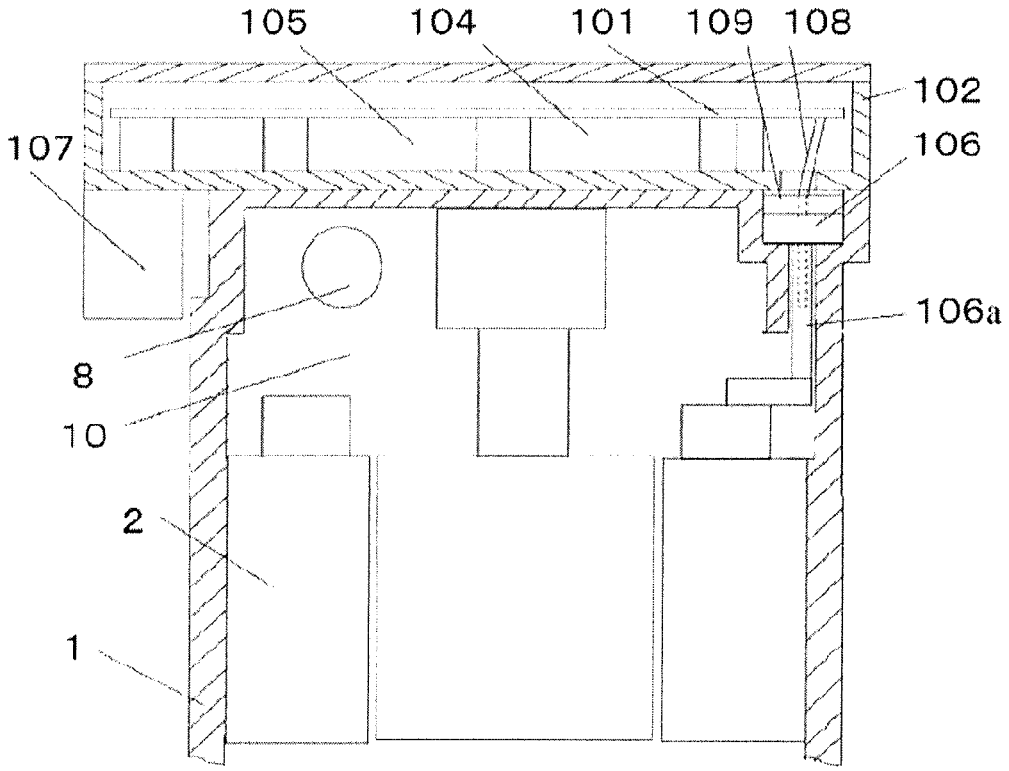
FIG. 12 is a partial sectional view of an electric compressor according to a second embodiment of the invention.
Figure 13:
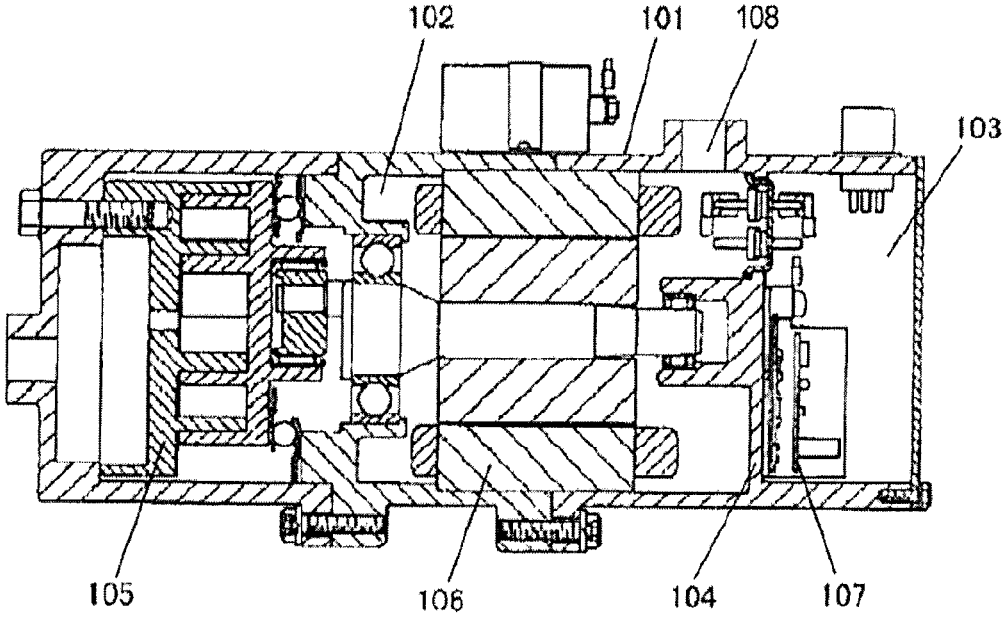
FIG. 13 is a sectional view showing an inverter-integrated electric compressor of a first conventional example.
Figure 14:
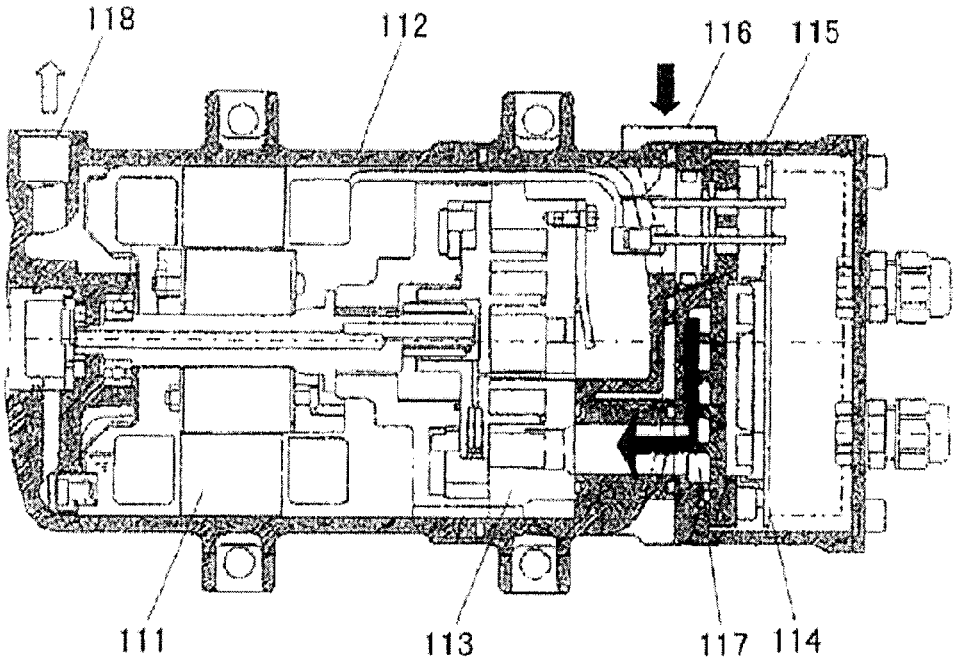
FIG. 14 is a sectional view showing an inverter-integrated electric compressor of a second conventional example.
Figure 15:
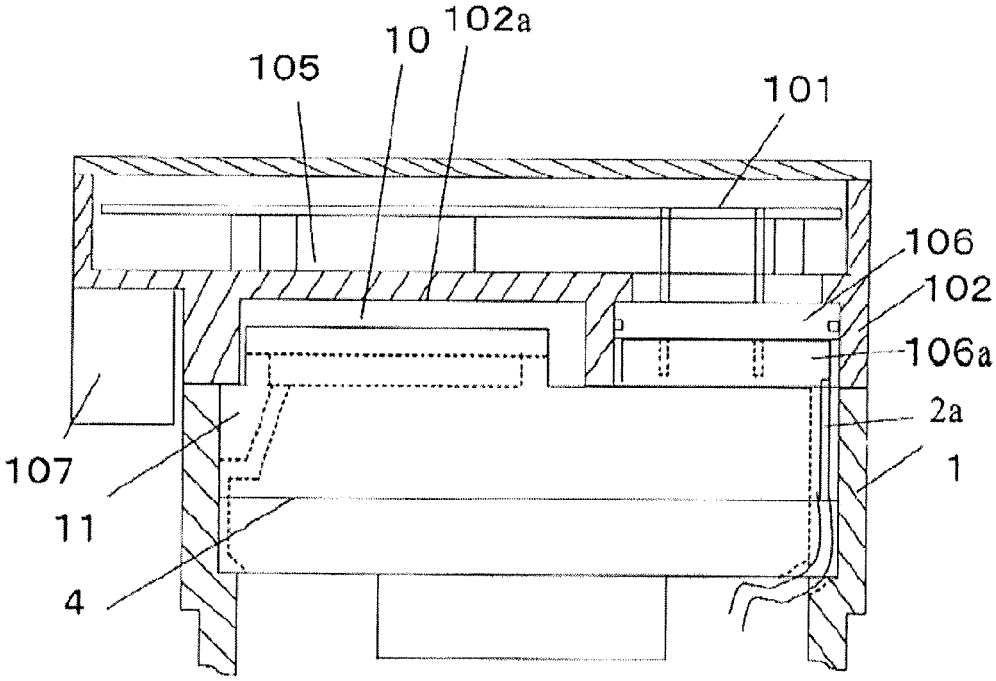
FIG. 15 is a sectional view showing an inverter-integrated electric compressor of a third conventional example.

FIG. 12 shows a configuration examination in the case of a so-called low pressure type electric compressor in which a pressure in the body casing 1 is low.

The motor 2 and the compressing mechanism portion (not shown) are disposed in the body casing 1, the motor 2 is adjacent to a suction chamber, refrigerant gas flows from the suction pipe mounting portion 8 of the body casing 1 to cool the motor 2 and then the refrigerant gas is introduced into the compressing mechanism portion (not shown).

In this case also, the inverter case 102 can effectively be cooled while applying the configuration shown in the first embodiment, and the inverter case can be mounted on the body casing 1 at any position.

According to the inverter-integrated electric compressor of each of the embodiments, the suction passage of the body casing 1 is tightly closed with the suction cover 5 which is formed independent from the suction passage. Alternatively, the suction cover 5 may be integrally formed on the body casing 1 on the side of the suction passage to tightly close the body casing 1, a side of the body casing 1 opposite from the suction cover may be opened, and the compressing mechanism portion 4 and the motor 2 may be inserted from this opening and they may be assembled.

INDUSTRIAL APPLICABILITY

According to the inverter-integrated electric compressor of the present invention, the inverter circuit substrate in the inverter case can efficiently be cooled by a refrigerant flowing through the suction passage. If a configuration as described in claim 2 is employed, installation flexibility of a suction pipe can largely be enhanced as compared with the conventional inverter-incorporated electric compressor, and if the inverter case itself is rotated without changing the position of the high voltage connector, the inverter case can be applied to the compressor and therefore, design efficiency is extremely enhanced. If the compressor body casing except the inverter case is closed with the suction cover, the configuration of the compressor becomes extremely useful for transportation, and there are many merits. For example, storage and management after the compressor is produced, it is easy to mount it in an engine, and it can widely be applied to an environment-friendly vehicle such as a hybrid vehicle.

The invention claimed is:

1. An inverter-integrated electric compressor comprising:

a compressing mechanism portion which sucks, compresses and discharges fluid, a motor which drives the compressing mechanism portion, a body casing in which the compressing mechanism portion and the motor are incorporated, the body casing including a suction cover which covers a side of the compressing mechanism portion, an inverter case in which an inverter for driving the motor is incorporated, a suction passage for refrigerant is formed in an internal hermetic space between the suction cover and the compressing mechanism portion, and the suction cover includes a suction passage-forming surface which covers the suction passage and a peripheral wall which provides a suction pipe mounting portion connected to the suction passage, wherein the suction cover has a first surface opposed to the suction passage-forming surface, the suction passage-forming surface is cooled by a refrigerant flowing through the suction passage, at least the inverter case is in close contact with the first surface and the inverter case is fixed to the first surface, and the inverter case is rotatably and slidably disposed on the first surface before being fixed to the body casing, and the compressor is adapted for the inverter case to be fixed to the body casing at one position selected from multiple positions on the first surface.

2. The inverter-integrated electric compressor according to claim 1, wherein an electrode end terminal of a compressor terminal is disposed on an axial end surface of the suction cover in which the suction passage is formed, and a circuit substrate in the inverter case is coupled to the electrode end terminal of the compressor terminal through a lead wire of the circuit substrate.

3. The inverter-integrated electric compressor according to claim 1, wherein at least one of a high voltage connector which introduces high voltage from outside, a communication connector and a low voltage connector is disposed in the inverter case.

4. The inverter-integrated electric compressor according to claim 2, wherein at least one of a high voltage connector, a communication connector and a low voltage connector is disposed on an outer periphery of the inverter case, and is connected to the circuit substrate of the inverter case through a connecting harness.

5. The inverter-integrated electric compressor according to claim 1, wherein at least central portions of the inverter case and the suction cover where the inverter case and the suction cover are fixed to each other have flat surfaces being closely brought into contact with each other, and at least portions of peripheries of the central portions are closely brought into contact with and fixed to each other through a thermal insulation material or a gap.

6. The inverter-integrated electric compressor according to claim 5, wherein the central portion of the inverter case is closely brought into contact with the central portion of the suction cover through a thermally conductive material.

7. The inverter-integrated electric compressor according to claim 1, wherein an outer peripheral portion of the inverter case has a cutout portion, a central portion of the cutout portion is connected to an inner surface of the inverter case through a plurality of coupling rods, the central portion is closely brought into contact with the first surface of the suction cover, and an end surface of the cutout portion of the inverter case is closely brought into contact with and fixed to an outer periphery of the suction cover through a thermal insulation material.

8. The inverter-integrated electric compressor according to claim 1, wherein the central portion of the inverter case is separated from an outer periphery and is fixed to the suction cover, and an end surface of the outer peripheral portion of the inverter case is closely brought into contact with and fixed to the suction cover through a thermal insulation material.

9. The inverter-integrated electric compressor according to claim 3, wherein depending on the one position selected from the multiple positions, a position of at least one of the high voltage connector, the communication connector and the low voltage connector relative to a position of the suction pipe mounting portion can be differentiated.

10. The inverter-integrated electric compressor according to claim 5, wherein at least the central portion of the inverter case is made of a metal.

11. The inverter-integrated electric compressor according to claim 6, the thermally conductive material is disposed between the inverter case and the first surface of the suction cover.

12. The inverter-integrated electric compressor according to claim 11, the thermally conductive material is a grease or a graphite sheet.

* * * * *